US007089865B2

(12) United States Patent
Regev

(10) Patent No.: US 7,089,865 B2
(45) Date of Patent: Aug. 15, 2006

(54) BULLET

(75) Inventor: Alon Regev, Misgav (IL)

(73) Assignee: Rafael Armament Development Authority Ltd., Haifa (IL)

( * ) Notice: Subject to any disclaimer, the term of this patent is extended or adjusted under 35 U.S.C. 154(b) by 0 days.

(21) Appl. No.: 10/518,167

(22) PCT Filed: Jun. 17, 2003

(86) PCT No.: PCT/IL03/00517

§ 371 (c)(1),
(2), (4) Date: Aug. 31, 2005

(87) PCT Pub. No.: WO03/106911

PCT Pub. Date: Dec. 24, 2003

(65) Prior Publication Data

US 2006/0130696 A1 Jun. 22, 2006

(30) Foreign Application Priority Data

Jun. 18, 2002 (IL) ..... 150295

(51) Int. Cl.

| | |
|---|---|
| ***F42C 13/00*** | (2006.01) |
| ***F42C 13/02*** | (2006.01) |
| ***F42C 13/08*** | (2006.01) |
| ***F42C 12/22*** | (2006.01) |
| ***F42C 30/02*** | (2006.01) |

(52) U.S. Cl. ..... 102/506; 102/211; 102/212; 102/213

(58) Field of Classification Search ..... 102/501, 102/506, 508, 509, 516, 517, 211, 212, 213, 102/214, 215

See application file for complete search history.

(56) References Cited

U.S. PATENT DOCUMENTS

| | | | | |
|---|---|---|---|---|
| 3,850,102 | A * | 11/1974 | Morrow | 102/210 |
| 4,332,468 | A * | 6/1982 | Stutzle | 356/5.05 |
| 4,388,867 | A * | 6/1983 | Baumer | 102/211 |
| 4,709,142 | A * | 11/1987 | Dahl | 250/221 |
| 4,733,609 | A * | 3/1988 | Goodwin et al. | 102/213 |
| 4,936,216 | A * | 6/1990 | Skagerlund | 102/213 |
| 4,987,832 | A * | 1/1991 | Klink et al. | 102/213 |
| 2004/0237825 | A1 * | 12/2004 | Ronn et al. | 102/211 |

* cited by examiner

*Primary Examiner*—Michael J. Carone
*Assistant Examiner*—James S. Bergin
(74) *Attorney, Agent, or Firm*—Gottlieb, Rackman & Reisman

(57) ABSTRACT

The present invention relates to a hollow bullet for a light weapon which comprises within said hollow: (a) At least one proximity sensor at the front portion of the bullet for sensing an object, and for providing a sensing indication of a proximity object to a control unit;—A control unit for providing a detonation signal to an explosive charge within the bullet upon receipt of said proximity indication;—and An explosive charge for detonating upon receipt of said detonation signal from said control unit.

6 Claims, 2 Drawing Sheets

BULLET

FIELD OF THE INVENTION

The present invention relates to ammunition for light weapon. More particularly, the invention relates to a bullet having a novel structure, which is capable of eliminating or damaging a target hidden behind or obstructed by another object, particularly strong and solid object.

BACKGROUND OF THE INVENTION

Light weapons, which are used against human beings, have been widely used for many years now. There are known a variety of ammunition for light weapons, such as: conventional bullets, tracing bullets that are mostly used under dark conditions, hollow point bullets that explode upon impact, hand grenades, shells, etc.

Hereinafter, when the terms "gun" or "rifle" are used, if not otherwise specifically stated, these should be understood as relating to any type of light weapon, such as a pistol, shotgun, hunting weapons, machine gun, automatic rifle, submachine gun, etc.

When shooting a bullet of any type with a rifle, very accurate aim is required in order to damage the target, as the bullet generally does not include any charge. If the bullet misses the target, the target suffers no damage. Even when the bullet hits an object proximate to the target, the damage to the target is in most cases minor. The ricochets that a bullet can cause are generally small in size, and without most of the energy of the impact, the resulting damage to the target is small. Therefore, whoever wants to escape from a direct hit by such a bullet has to seek protection behind a strong and solid object. In such a case, if the bullet cannot penetrate this solid object, or event when it penetrates but loses most of its energy, the target generally escapes significant damage.

The art has failed to provide means for a light weapon firing a bullet to hit a target hidden behind a strong and solid object. The only solution that the art has provided to that problem is the firing of a hand grenade, or a heavier projectile containing explosive charge by means of a heavier weapon. Moreover, no solution has been provided yet by the art for the case in which the bullet passes very close to the target, but misses it.

It is therefore an object of the present invention to provide a bullet for a light weapon, which can cause significant damage to a target, even without directly hitting it.

It is another object of the present invention to provide a bullet that can damage a target hidden behind a strong and solid object.

It is still another object of the present invention to provide said bullet with no change to the structure of the cartridge or the firing weapon.

Other objects and advantages of the invention will become apparent when the description proceeds.

SUMMARY OF THE INVENTION

The present invention relates to a hollow bullet for a light weapon, which comprises within said hollow: a. at least one proximity sensor at the front portion of the bullet for sensing an object, and providing a sensing indication of a proximity object to a control unit; b. control unit for providing a detonation signal to an explosive charge within the bullet upon receipt of said proximity indication; and c. an explosive charge for detonating upon receipt of said detonation signal from said control unit.

Preferably, a distance threshold is predefined at the control unit, which comprises a comparator for comparing a sensed signal from said at least one proximity sensor with said predefined distance threshold, for outputting a detonation signal when said comparison shows a sensed object in a distance below said threshold.

Preferably, said sensor is an optical sensor, the control unit further comprising optical means. Said optical sensor may be, for example, a laser-based sensor.

According to another embodiment of the invention, said sensor is a magnetic sensor.

DETAILED DESCRIPTION OF PREFERRED EMBODIMENTS

As said, the art has failed to provide means for significantly damaging a target by firing a bullet from a light weapon, other than directly hitting the target. This requires very accurate aim by the one who fires the bullet. Moreover, the art has not provided means for a light weapon to hit a target which is hidden behind a strong and solid object.

The present invention provides a bullet for a light weapon that overcomes said drawbacks. According to the present invention, the bullet is provided with means causing it to explode in proximity of the target, even when not hitting it directly.

Figure 1:
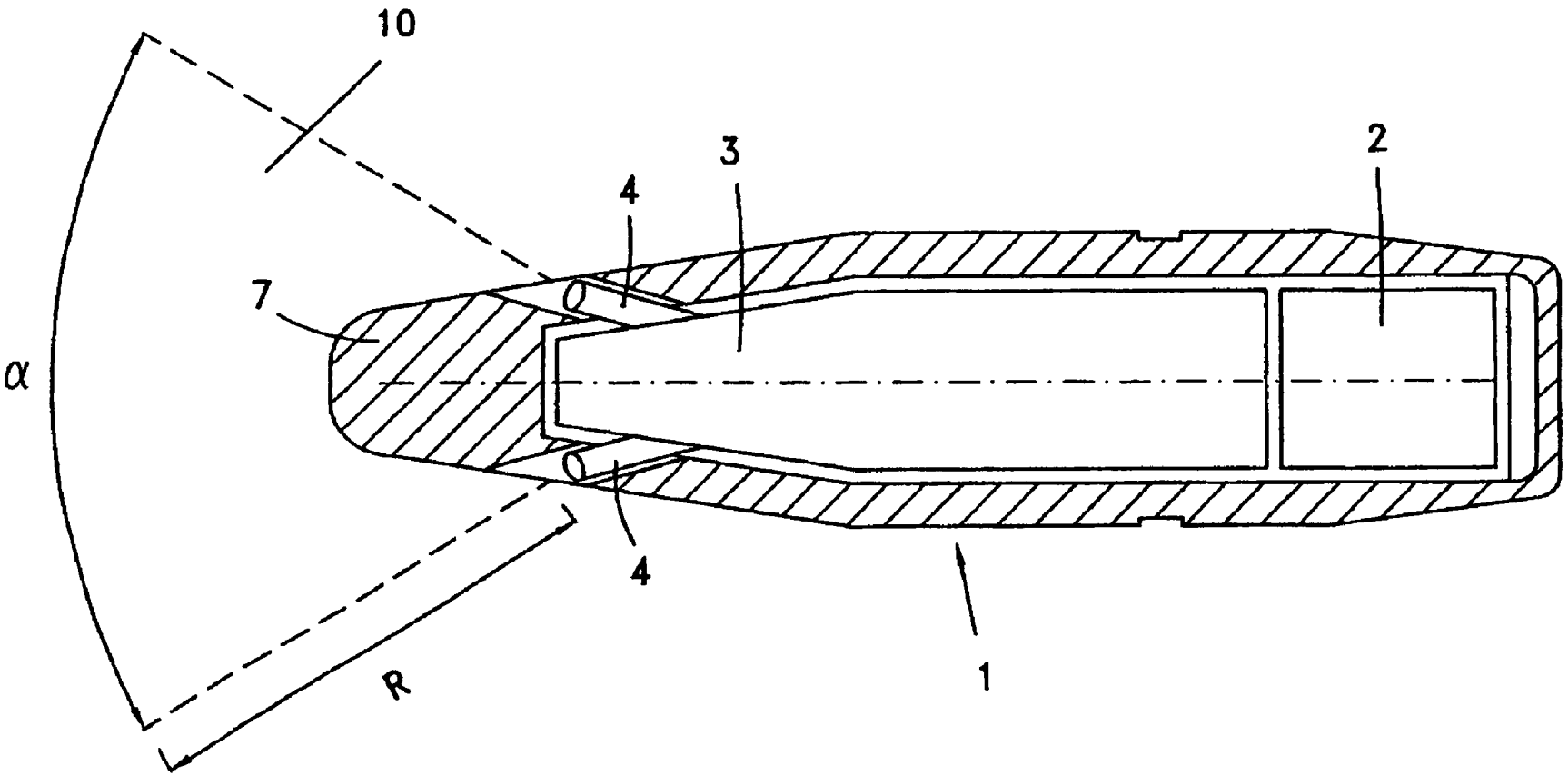
FIG. 1 shows a structure of a bullet for a light weapon, according to one embodiment of the invention.

FIG. 1 shows a structure of a bullet 1, according to one embodiment of the invention. The bullet 1 is essentially hollow, having an outer casing 7, made of a conventional material as is commonly used in bullets of the prior art. The bullet of the present invention is characterized by being provided with proximity sensing means being provided with a distance threshold. When an object is sensed by said means below said distance threshold, a signal is given by said means, causing the bullet to explode. More particularly, the proximity sensing means comprise one or more sensors 4 that can sense and provide an indication for the existence of an object within a space in front and around the bullet, as indicated by the numeral 10. The borders of the space 10 are determined by the directivity of each sensor and its sensitivity. The directivity of the sensor determines the angle $\alpha$, and its sensitivity determines the range R. The operation of the sensors is supported and controlled by the control unit 3. The control unit 3 comprises:

1. a power source, such as a small battery;
2. a threshold setting circuit that sets a threshold distance. The threshold distance may be, for example, in the range of 0–70 cm.;
3. a comparator, receiving a signal from the sensors 4, comparing the same with said threshold, and if an object is found below, i.e., closer than the threshold, outputting a signal to explode the explosive charge 2.

The sensors may be of various types known in the art, for example, optical sensors (for example, laser based sensors), magnetic sensors, etc.

The explosive charge can be of any type known in the art, and it should contain enough charge capable of exploding the bullet to pieces.

Figure 2:
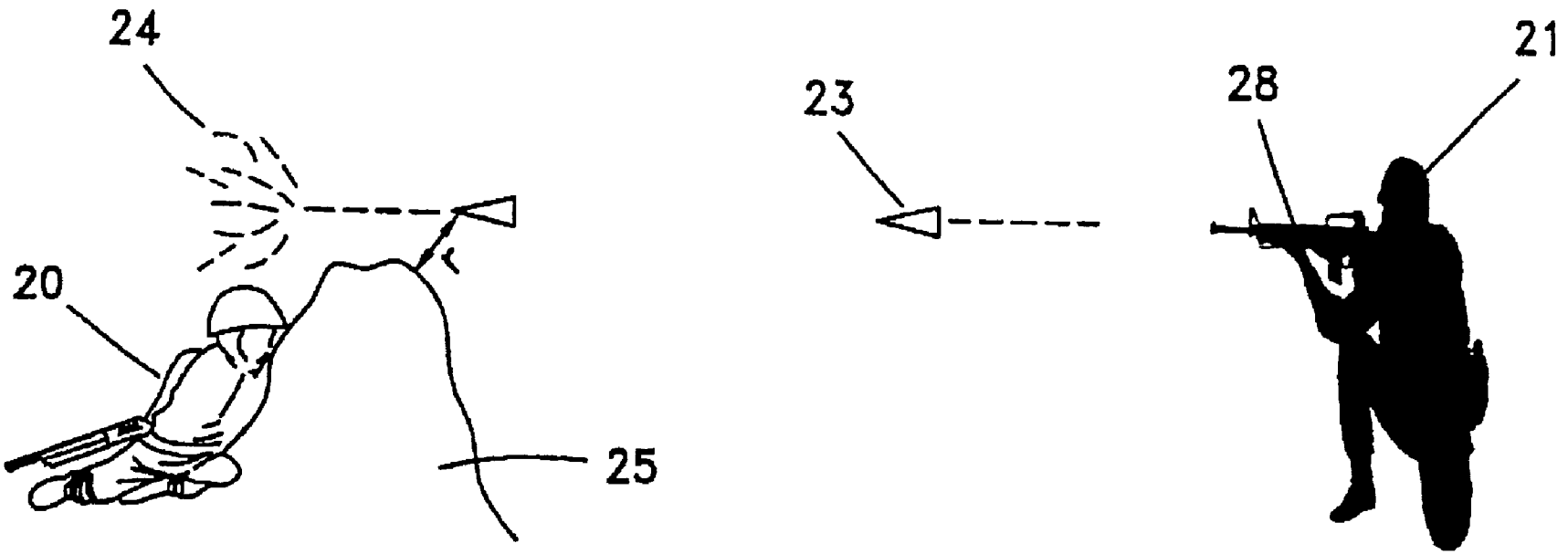
FIG. 2 illustrates the operation of the bullet of the invention, when shot from a light weapon towards a target hidden behind a solid and strong object.

FIG. 2 shows how the explosion of the bullet can cause portions of it to reach hidden locations that cannot be reached by bullets of the prior art. As shown, a soldier 21 targets another soldier 20, hiding behind the solid object 25. As the object 25 is a solid, strong object, there is no way for soldier 21 to strike soldier 20, using his light weapon 28 from his current location, if a conventional bullet is fired. However, when using the bullet of the invention, this is possible.

As shown in FIG. 2, a bullet 23 according to the present invention is fired from the same gun 28. In such a case, the soldier aims towards a location slightly above the object 25. When the bullet reaches a location proximate to object 25, and when the range r to the object falls below the threshold distance R, the control unit, receiving such an indication, signals the explosive charge 2 to detonate. When the explosion occurs, the kinetic energy of the bullet directs the fragments behind the object 25. In such a manner, pieces of the bullet can inflict injury on soldier 20, which cannot be obtained when a conventional bullet is used.

It should be noted that certain considerations should be taken before using the bullet of the invention. For example, use of the bullet of the invention may not be applicable in cases when shooting through objects made of soft or penetrable materials towards targets that are located far from said objects, for example, when such an object is a glass window. In such a case, a premature explosion may occur, upon reaching the said object, which in some cases may even endanger the soldier firing.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. A hollow bullet for a light weapon, for hitting a target obstructed by a non-penetrable solid object, which comprises within said hollow:

At least one proximity sensor at the front portion of the bullet for sensing said object, and providing a sensing indication of a proximity of said object to a control unit;

A control unit for providing a detonation signal to an explosive charge within the bullet upon receipt of said proximity indication; and An explosive charge for detonating upon receipt of said detonation signal from said control unit, wherein upon said detonation said bullet splits into fragments, therefore to hit said target by at least one of the bullet fragments, and wherein said bullet is shot to a direction proximate to an edge of said solid object, not to the solid object itself.

2. A bullet according to claim 1, wherein a distance threshold is predefined at the control unit, which comprises a comparator for comparing a sensed signal from said at least one proximity sensor with said predefined distance threshold, for outputting a detonation signal when said comparison shows a sensed object in a distance below said threshold.

3. A bullet according to claim 1, wherein said sensor is an optical sensor, the control unit further comprising optical means.

4. A bullet according to claim 3, wherein said optical sensor is a laser-based sensor.

5. A bullet according to claim 1, wherein said sensor is a magnetic sensor.

6. A method for hitting a target obstructed behind a non-penetrable solid object by means of a light weapon, which comprises the steps of:

a. Providing a hollow bullet for the light weapon;

b. Providing within said hollow at least one proximity sensor at the front portion of the bullet for sensing said solid object, and providing a sensing indication of a proximity of said object to a control unit:

c. Providing a control unit within said hollow for causing a detonation signal to an explosive charge within the bullet upon receipt of said proximity indication; and d. Providing an explosive charge for detonating upon receipt of said detonation signal from said control unit, wherein upon said detonation said bullet splits into fragments, therefore hitting said target by at least one of the bullet fragments; and, e. Shooting said bullet to a direction proximate to an edge of said solid object, but not to the solid object itself.

* * * * *